US011173702B2

(12) United States Patent
Flemming

(10) Patent No.: US 11,173,702 B2
(45) Date of Patent: Nov. 16, 2021

(54) METHOD FOR SETTING THE LAYER THICKNESS OF A COVERING COATING MATERIAL TO BE APPLIED TO A SUBSTRATE BY AN APPLICATION DEVICE

(71) Applicant: KOENIG & BAUER AG, Würzburg (DE)

(72) Inventor: Steven Flemming, Berlin (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 15/734,255

(22) PCT Filed: Aug. 9, 2019

(86) PCT No.: PCT/EP2019/071451
§ 371 (c)(1),
(2) Date: Dec. 2, 2020

(87) PCT Pub. No.: WO2020/043463
PCT Pub. Date: Mar. 5, 2020

(65) Prior Publication Data

US 2021/0162734 A1 Jun. 3, 2021

(30) Foreign Application Priority Data

Aug. 31, 2018 (DE) ..... 10 2018 121 301.8

(51) Int. Cl.
*B41F 33/00* (2006.01)
*B05D 1/28* (2006.01)
*B41J 11/00* (2006.01)

(52) U.S. Cl.
CPC ..... *B41F 33/0045* (2013.01); *B05D 1/28* (2013.01); *B41F 33/0027* (2013.01); *B41J 11/0015* (2013.01); *B05D 2252/02* (2013.01); *B41P 2233/11* (2013.01); *B41P 2233/30* (2013.01); *B41P 2233/51* (2013.01)

(58) Field of Classification Search
CPC ..... B41P 2233/11; B41P 2233/30; B41P 2233/51; B41J 11/0015; B41F 33/0045; B41F 33/0027; B05D 1/28
See application file for complete search history.

(56) References Cited

U.S. PATENT DOCUMENTS 4,947,746 A 8/1990 Jeschke et al.
5,031,534 A 7/1991 Brunner
(Continued)

FOREIGN PATENT DOCUMENTS

DE 3226144 A1 2/1983
DE 3411836 A1 10/1984
(Continued)

OTHER PUBLICATIONS

International Search Report of PCT/EP2019/071451 dated Nov. 14, 2019.

*Primary Examiner* — David H Banh
(74) *Attorney, Agent, or Firm* — Mattingly & Malur, PC

(57) ABSTRACT

A method is provided for setting a layer thickness of a covering coating material to be applied to a substrate by an application device. The coating material is applied to the substrate in a printing machine or in a paper-processing machine. The coating material is applied at various points on the substrate by the use of the application device in a machine process. At each of at least one first point on the substrate, the coating material is applied in a grid having a plurality of grid points, and at each of at least one other second point on the substrate, the coating material is applied over the full area. Each first point on the substrate forms a grid zone and each second point on the substrate forms a solid zone. A control unit connected to a sensing device determines respective values of the optical density of the layer of the coating material applied on the points on the substrate using data captured by the sensing device at the
(Continued)

first and second points on the substrate. The control unit defines the layer thickness of the coating material currently applied to the substrate by the application device in an ongoing machine process. At the defined thickness, the value of the optical density determined in a grid zone corresponds to the value of the optical density determined in a solid zone, as the layer thickness of the coating material having an opacity of 100%.

10 Claims, 2 Drawing Sheets

(56) References Cited

U.S. PATENT DOCUMENTS

| | | | | |
|---|---|---|---|---|
| 8,973,500 | B2 | 3/2015 | Elter et al. | |
| 2003/0217659 | A1* | 11/2003 | Yamamoto | B41F 33/0045 101/350.1 |
| 2004/0177784 | A1* | 9/2004 | Yamamoto | B41F 33/0045 101/484 |
| 2013/0014659 | A1 | 1/2013 | Elter et al. | |
| 2015/0090136 | A1 | 4/2015 | Rancourt et al. | |
| 2015/0090137 | A1* | 4/2015 | Rancourt | B41F 7/04 101/142 |

FOREIGN PATENT DOCUMENTS

| | | | |
|---|---|---|---|
| DE | 3543444 | A1 | 10/1986 |
| DE | 3818405 | A1 | 12/1989 |
| DE | 3830121 | A1 | 3/1990 |
| DE | 102007005018 | A1 | 8/2007 |
| DE | 102007061397 | A1 | 6/2009 |
| DE | 102012012517 | A1 | 1/2013 |
| DE | 102014011151 | A1 | 2/2015 |
| EP | 0272468 | A2 | 6/1988 |
| EP | 490093 | A1 | 6/1992 |
| EP | 1275502 | A1 | 1/2003 |

* cited by examiner

METHOD FOR SETTING THE LAYER THICKNESS OF A COVERING COATING MATERIAL TO BE APPLIED TO A SUBSTRATE BY AN APPLICATION DEVICE

CROSS-REFERENCE TO RELATED APPLICATIONS

This application is the US National Phase, under 35 USC, § 371, of PCT/EP2019/071451, filed Aug. 9, 2019; published as WO 2020/043463 A1, on Mar. 5, 2020, and claiming priority to DE 10 2018 121 301.8 filed Aug. 31, 2018, the disclosures of which are expressly incorporated herein in their entireties by reference.

FIELD OF THE INVENTION

The present invention relates to a method for setting a layer thickness of an opaque coating material to be applied to a substrate by an application device. The coating material is applied to the substrate in a printing machine or in a paper-processing machine. The coating material is applied at various points on the substrate by the use of the application device in a machine process. At each of at least one first point on the substrate, the coating material is applied in a grid having a plurality of grid points, and at each of at least one other second point on the substrate, coating materials are applied over the full area. Each first point on the substrate forms a grid zone and each second point on the substrate forms a solid zone. A control unit connected to a sensing device determines the respective value for the optical density of the layer of the coating material applied at the point on the substrate from data captured by the sensing device at the first and second points on the substrate.

BACKGROUND OF THE INVENTION

DE 38 18 405 A1 discloses a method for determining the coloration for the different paper-color combinations used in the printing industry, wherein a uniform color profile is set on the printing machine, the same ink quantity is supplied zonally, and the thickness of the ink application is determined by means of an ink consumption surface of a printing aid.

U.S. 2015/0 090 136 A1 discloses a method for controlling the thickness of an ink film, wherein the ink film is applied to a printed substrate in a lithographic printing machine, which contains a plurality of printing units, wherein each printing unit contains a blanket cylinder, a plate cylinder, a take-off roller, and an inking unit, comprising the following: (a) filling the inking cylinder in one or several of the plurality of printing units of the printing machine in a non-printing position, wherein each printing unit contains a blanket cylinder; moving the removing roller in the one or the several printing units of the plurality of the printing units into contact with the blanket cylinder of the printing unit; and subsequently driving the inking unit, the plate cylinder, the blanket cylinder, and the removing roller and thereby transferring printing ink from the inking unit to the plate cylinder, from the plate cylinder to the blanket cylinder, and from the blanket cylinder to the removing roller; (b) moving the removing roller out of contact with the blanket cylinder of the printing unit in the one or the several printing units of the plurality of printing units; (c) arranging the one or the several printing units in the printing position; (d) printing onto the substrate with the one or the several printing units when the substrate moves through the printing machine; (e) measuring an optical density on the moving substrate with an optical sensor; (f) comparing the measured optical density with a predefined metric and, when the measured optical density is within a predefined metric, continuing the printing on the substrate and, when the measured optical density is outside of the predefined metric, repeating steps (a) to (f).

DE 34 11 836 A1 discloses a method for controlling the supply of ink and dampening means in planographic printing machines by measuring control marks also printed and subsequently evaluating the measured values, wherein the obtainment of the measured values for determining the ink density and the dampening takes place at the same control marks, signals are obtained which are used to evaluate the dampening and ink density variables, and then the existing dampening and ink density values are calculated and compared with predefined set values within specified tolerance limits by means of a microcomputer, wherein separate control signals are generated for controlling the inking and dampening unit due to the formation of differential signals between set values and actual values.

DE 10 2007 061 397 A1 discloses a printing machine with a device for transferring imaging layers from a transfer film to sheets with at least one application device for an image-wise coating of the sheets with an adhesive and with a coating device downstream thereof for transferring the imaging layers from the transfer film to the sheets, wherein a measuring system based on the sheets is arranged between the application device and the coating device, wherein the opacity of the adhesive layer is measurable with the measuring system and/or wherein control zones and/or measuring strips outside of the print image are detectable with the measuring system.

DE 32 26 144 A1 discloses a method for setting the ink metering on printing machines with an objective presetting of ink metering variables with consideration of machine-influencing variables, wherein, in order to detect the change in the influence of the machine-influencing variables, the paper quality, and the ink properties on the optical density after a presetting of the ink metering, a measuring of the zonal optical density of the printed solid surfaces of a removed printed product is carried out, the comparison between the existing and the required optical density is implemented, and, in the event of a difference in the density values which is outside of a predefined tolerance range, the calculation of the surface portion to be printed and of the resulting ink blade gap is carried out again iteratively, and the setting of the ink blade is executed, and these steps are repeated until the difference between the existing and the required optical density is within the predefined tolerance range.

DE 10 2014 011 151 A1 discloses a method for color control in printing machines having a computing unit by means of detecting color surfaces on a surface to be printed with a colorimeter, wherein the surface to be printed is a printing substrate, wherein the printing substrate is coated with opaque white, wherein the colorimeter detects several color measurements of opaque white, and wherein the computing unit compares the detected color measurements of the opaque white with one another or against a reference color value of the opaque white and stores the deviations determined during the comparison in the computing unit, wherein the printing substrate coated with the opaque white is printed over with color measuring fields, wherein the printed-over color measuring fields are detected by means of the colorimeter, and wherein the computing unit considers the influence of the stored determined deviations during the comparison in order to regulate the coloration of the color measuring values of the color measuring fields underlaid with opaque white with the target color values of the print master.

DE 10 2007 005 018 A1 discloses a method for color control of duplication copies of a printing machine, in which a substrate, which appears to be dark in a standardized color measurement, is printed with at least one printing ink, which is lighter than the substrate, and at least one color value of the printing ink is determined from a measured variable, wherein the color value of the at least one printing ink is regulated with the aid of an established reference value of a color location in the color space, which is brighter than the printing ink.

Coating in production technology is understood to be a primary group of production methods according to DIN 8580 (2003 September edition), which are used to apply an adhering layer comprising formless substance onto the surface of a solid carrier material, which is also designated as the substrate. The corresponding process as well as the applied layer itself are each characterized as coating.

The application of a liquid or a paste, i.e. with high viscosity, or a powder coating material onto a substrate in a machine coating method is described in the following. In this process, after the coating material is applied and optionally after a physical drying and/or a chemical curing on the substrate, the coating material forms a layer which is thin, e.g. in the micrometer range or in the nanometer range, as compared to the material thickness of the substrate. The coating materials also include film-forming coating agents and/or coating materials, which also include, e.g., printing inks, varnishes, inks, or India inks used in the graphics industry or in printing technology and, e.g., coating colors used in the paper industry for surface finishing.

In the preferred embodiment in this case, the substrate is formed as a printing substrate. In this case, the printing substrate consists particularly of paper, paperboard, cardboard, sheet-metal, textiles, glass, ceramics, or a film comprising metal or comprising a plastic. A printing substrate formed, for example, from paper, paperboard, cardboard, film, sheet-metal, or textiles is formed particularly flat as a sheet or as a material web. A printing substrate formed, for example, from sheet metal, plastic, glass, or ceramics may also be formed as a hollow object, e.g. as a container, preferably as a can or as a cup or as a bottle or as a tube. The coating material to be applied to the respective substrate is preferably a colorant, i.e. a color-providing inorganic or organic substance, which may be of natural or synthetic origin and has pigments or at least one dye.

The coating to be implemented according to the invention takes place particularly in an industrial process in a machine processing the respective substrate, preferably in a printing machine or in a paper-processing machine.

The coating material to be applied to the respective substrate may be formed as opaque or varnished. A varnishing coating material may be transparent, i.e. permeable as relates to image or view, or translucent, i.e. partially permeable to light. In contrast, a covering coating material is opaque, i.e. impermeable to light, at least starting at a certain layer thickness applied to the respective substrate. Accordingly, translucence and opacity are reciprocal properties to one another. The opacity is accordingly a measure of the visual opacity or turbidity of translucent materials, i.e. materials and layers permeable to scattered light. In the paper sector, it is customary to indicate the opacity for a respective sheet or page according to ISO 2471. The opacity is defined approximately therein as O=100% minus translucency. A sheet of paper with a translucency of 1% accordingly has an opacity of 99%.

In printing technology, covering printing inks are frequently used for functional or decorative reasons. These printing inks may be, e.g., primary colors such as red, green, and blue, or cyan, magenta, and black, but also opaque white or various metallic colors such as, e.g., gold or silver.

An application of a coating material onto a substrate, which is carried out in an industrial process with an application device, e.g. in a printing machine or in a paper-processing machine, is particularly continually monitored to support the production of a desired quality of the coating during ongoing operation of the printing machine or the paper-processing machine inline and/or online, i.e. during production within and/or outside of the respective machine, normally with a sensing device which functions without contact, e.g. with a sensing device which functions in an optoelectronic measuring method, preferably densitometrically or spectrophotometrically. During this monitoring, it is of particular interest to obtain knowledge about the layer thickness already applied to the respective substrate. The problem is that, during monitoring of a covering coating material in a densitometric or spectrophotometric measuring method, the measured values collected, e.g. for the optical density or a brightness value or a color location of the coating material in question, no longer change starting from a particularly applied layer thickness, that is when an opacity of 100% is reached at the latest. Consequently, there is the risk that the covering coating material will be applied to the respective substrate in an unnecessarily large layer thickness in the industrial process, which is uneconomical at a minimum and additionally makes the respective substrate unnecessarily heavy.

An application device, which is arranged in a printing machine or a paper-processing machine, for automatic application of a coating material onto a substrate preferably has a metering device which is controlled or regulated by a control unit, wherein this metering device influences a respective quantity of the coating material to be applied to the substrate due to the setting, e.g., of a width of at least one discharge opening of a reservoir supplying the coating material and/or of a cycle of a lifter transferring the coating material, wherein the lifter transfers the coating material from a reservoir supplying the lifter to an applicating or transferring roller, and/or of a rotational speed of a roller, particularly of a ductor roller, applying or transferring the coating material.

SUMMARY OF THE INVENTION

The object upon which the present invention is based is to obtain a method for setting a layer thickness of a covering coating material to be applied to a respective substrate by an application device, particularly in a printing machine or in a paper-processing machine, with which the layer thickness of the covering coating material applied to the substrate in question is set at a predetermined value, particularly at a value associated with an opacity of 100%, and/or is maintained constantly at this value.

The object is achieved according to the present invention by the provision of the control unit defining the layer thickness of the coating material currently applied to the substrate by the application device in the ongoing machine process, at which layer of thickness the value (D R) of the optical display determined in a grid zone corresponds to the value (D V) of the optical density determined in a solid zone, as the layer thickness of the coating material having an opacity of 100%.

A first solution is particularly that a control unit connected to the sensing device determines a value, particularly as a function of the layer thickness, for the opacity of the layer of coating material applied to the substrate, wherein the control unit sets the layer thickness of the coating material to be applied to at least one further substrate by the application device preferably starting from at least a value of the opacity determined during an accumulating layer structure such that the layer of the coating material to be applied to the at least one further substrate with the application device achieves a value for the opacity previously defined in the control unit preferably in a range of at least 95% to 100% and/or retains said value during ongoing production operation.

A second solution may be that the coating material is applied at various points on the substrate in question by means of the application device in a printing process, wherein, at each of at least one first point on the substrate in question, the coating material is applied in a grid having a plurality of grid points, and, at each of at least one other second point on the substrate in question, the coating material is applied over the full area, wherein each first point in question on the substrate in question forms a grid zone and each second point in question on the substrate in question forms a solid zone, wherein a control unit connected to a sensing device determines a respective value for the optical density of the layer of the coating material applied at the points in question on the substrate from data captured by the sensing device at the first and second points on the substrate in question, wherein the control unit defines the layer thickness of the coating material currently applied to the substrate in question by the application device in the ongoing printing process, at which layer thickness the value of the optical density determined in a grid zone corresponds to the value of the optical density determined in a solid zone, as the layer thickness of the coating material having an opacity of 100%.

The advantages achievable with the invention are particularly that the layer thickness of the covering coating material applied to the substrate in question by the application device is set at a value previously defined in the control unit, particularly at a value associated with an opacity in a range of at least 95% to 100% and/or can be maintained constantly at this value. The use of the covering coating material is thereby optimized specifically in an industrial process executed by a printing machine or a paper-processing machine.

BRIEF DESCRIPTION OF THE DRAWINGS

Exemplary embodiments of the invention are shown in the figures and described in greater detail in the following.

The following is shown.

The invention is explained without limitation in the following using the example of a printing machine, preferably a rotary printing machine, particularly a sheet-fed rotary printing machine. The printing machine can execute its printing process, e.g., in an offset printing process or in a flexographic printing process or in a screenprinting process or in an inkjet printing process.

Figure 1:
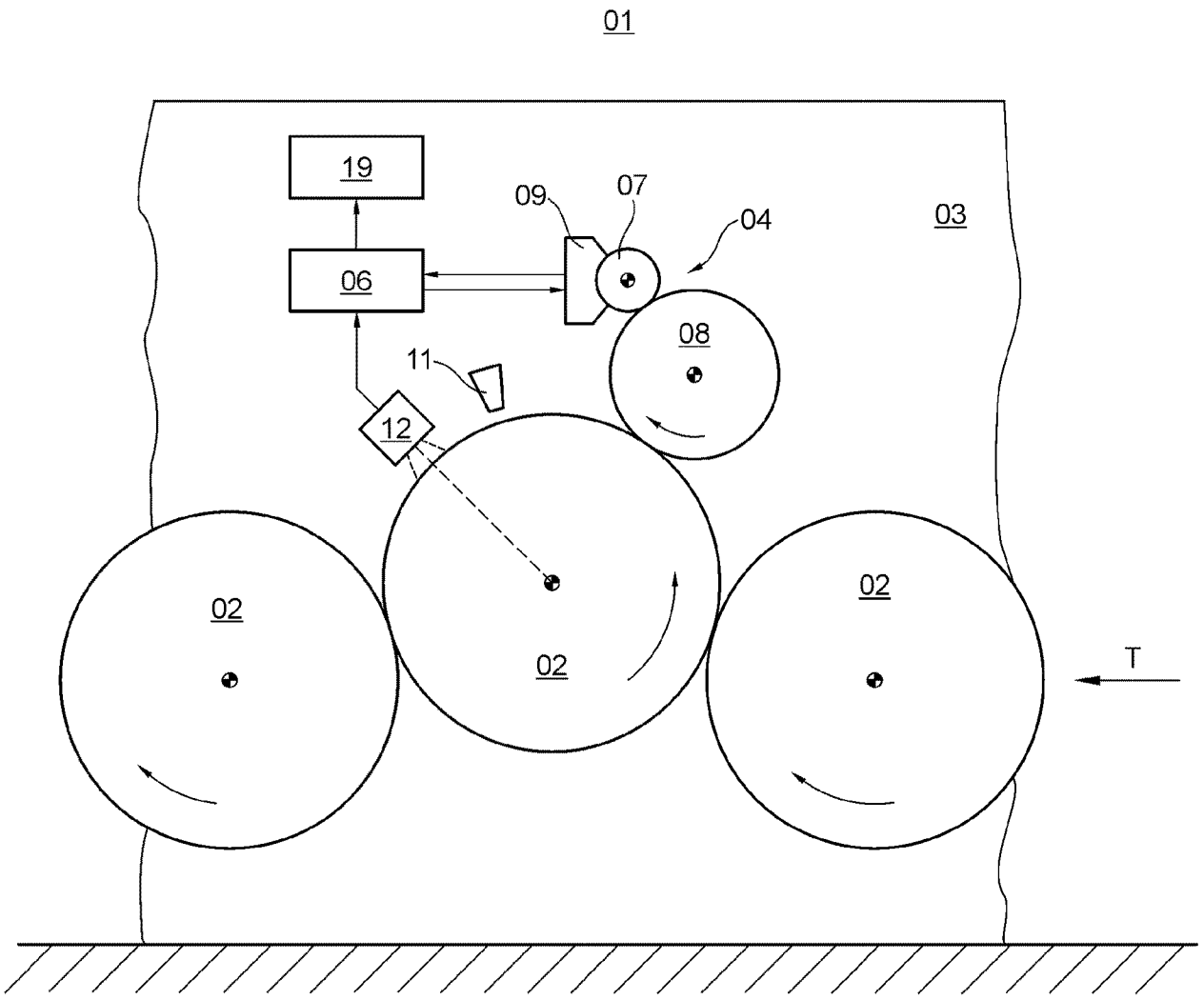
FIG. 1 a machine unit of a printing machine with an application device.

FIG. 1 shows, in a simplified and schematic manner, a machine unit 01, in a section from the printing machine, having a transport device arranged in a frame 03 for the transport of at least one substrate (FIG. 2), for example, formed respectively as a sheet 13 to be processed in this printing machine, particularly to be printed, wherein this transport device has, e.g., at least one transport cylinder 02, or preferably several successive, e.g. three or more successive, transport cylinders 02, in the preferred embodiment in the transport direction T of the at least one substrate. The respective rotational direction of the transport cylinder 02 is respectively indicated by a directional arrow. Holding elements which are formed, e.g., as grippers or as suction devices on the respective transport cylinders 02 fix the respective substrate in position during its transport from one transport cylinder 02 to the next transport cylinder 02 on the particular casing surface of the respective transport cylinder 02. The respective transport cylinders 02 are formed, e.g., in multiple sizes such that two or three or even more substrates are arranged or at least can be arranged successively on the respective outer circumference of the transport cylinders.

The machine unit 01 shown in FIG. 1 has an application device 04, in interaction with one of the transport cylinders 02, for applying a covering coating material to the respective substrate transported by the transport cylinder 02 in question during its rotation. This covering coating material, for example, is a covering printing ink, which is formed, for example, as a primary color or as an opaque white or as a metallic color. A layer thickness of the coating material applied to the substrate with the application device 04 is, for example, in the micrometer range or nanometer range. In one printing machine, the application device 04 is formed, for example, as a metering device controlled or regulated by a control unit 06, wherein this metering device influences a respective quantity of the coating material to be applied to the substrate due to the setting of a width of at least one discharge opening of a reservoir supplying the coating material, e.g. an ink duct or doctor blade system 09, and/or of a cycle of a lifter transferring the coating material and/or of a rotational speed of a roller, e.g. a ductor roller 07 and/or forme roller 08, applying or transferring the coating material. The application device 04 may be arranged in the printing machine, in the transport direction T of the at least one substrate, e.g. upstream of a printing unit belonging to the printing machine, in order, for example, to initially apply an opaque white to the respective substrate, before the layer formed from the opaque white is printed over, at least partially, with at least one other printing ink. On the other hand, the application device 04 may also be arranged in the printing machine, in the transport direction T of the at least one substrate, downstream of a printing unit belonging to the printing machine in order to print over, at least partially, at least one printing ink already applied to the respective substrate and thus to create, for example, a printing result which can be backlit with a special effect. The applying of the covering coating material to the respective substrate can be carried out over the complete surface or partially or in halftone. The layer of the covering coating material applied to the respective substrate with the application device 04 in the printing machine may also have or be a primer coat for improved adherence. If necessary, an application of the covering coating material in the printing machine can also take place multiple times on the same substrate, wherein, for example, more than one single machine unit 01 is arranged with a respective application device 04 in the transport direction T of the substrate in question. Furthermore, a device for physical drying and/or for chemical curing may be provided in the printing machine, in the transport direction T of the at least one substrate, downstream of the application device 04, wherein the device for physical drying is formed, for example, as a hot air dryer 11 and/or as an infrared dryer 11, and the device for chemical curing is formed, for example, as a UV dryer 11.

The layer thickness of the coating material applied to the substrate with the application device 04 is monitored with a sensing device 12, wherein the sensing device 12 collects measured values inline, i.e. during production, from the covering coating material applied to the respective substrate during an ongoing operation of the printing machine. The sensing device 12, which is arranged within the printing machine, is connected to the respective control unit 06, wherein the control unit 06 determines a value for the opacity of the layer of the coating material applied to the substrate from the measured values previously recorded by the sensing device 12. The signal paths and signal directions from the sensing device 12, via the control unit 06, to the application device 04 are indicated by directional arrows in FIG. 1. In particular, operating data and/or control data may also be provided bidirectionally between the control unit 06 and the application device 04. It is provided that, following the determination of the current value for the opacity of the layer of the coating material already applied to the substrate, the control unit 06 sets the layer thickness of this coating material to be applied to at least one further substrate by the application device 04 such that the layer of the coating material to be applied to the at least one further substrate with the application device 04 achieves a value, which was previously specified in the control unit 06, e.g. by means of a manual or automated entry, preferably a freely selectable value, for the opacity which is normally within the scope of permissible tolerances and/or the control unit retains the value normally within the scope of the aforementioned tolerances in ongoing operation of the printing machine. In the preferred embodiment, the control unit 06 sets the application device 04 such that the layer of the coating material to be applied to the at least one further substrate with application device 04 achieves a value for the opacity and/or retains it during ongoing operation of the printing machine in a range of at least 95% to 100%.

The sensing device 12 preferably functions without contact and/or with an optoelectronic measuring method and/or densitometrically or spectrophotometrically. In an especially preferred embodiment, the sensing device 12 is formed as a camera, e.g. as a grayscale camera or as an RGB camera or as a CMYK colorimeter camera, wherein the control unit 06 determines the current value for the opacity of the layer of the coating material applied to the substrate, for example, by means of an evaluation of one or more images of the substrate taken by the camera, i.e. from at least one photographic depiction and/or from the underlying image data. In a further design variant, the sensing device 12 is formed as a reflection light sensor. The control unit 06 sets the layer thickness of the coating material applied to the substrate by the application device 04, particularly starting from at least a value of the opacity determined during an accumulating layer structure, e.g. in a start-up of the printing machine or in a different operating phase of the printing machine, in which the translucency of the layer of the coating material applied to the substrate decreases continually to the point of opacity.

Figure 2:
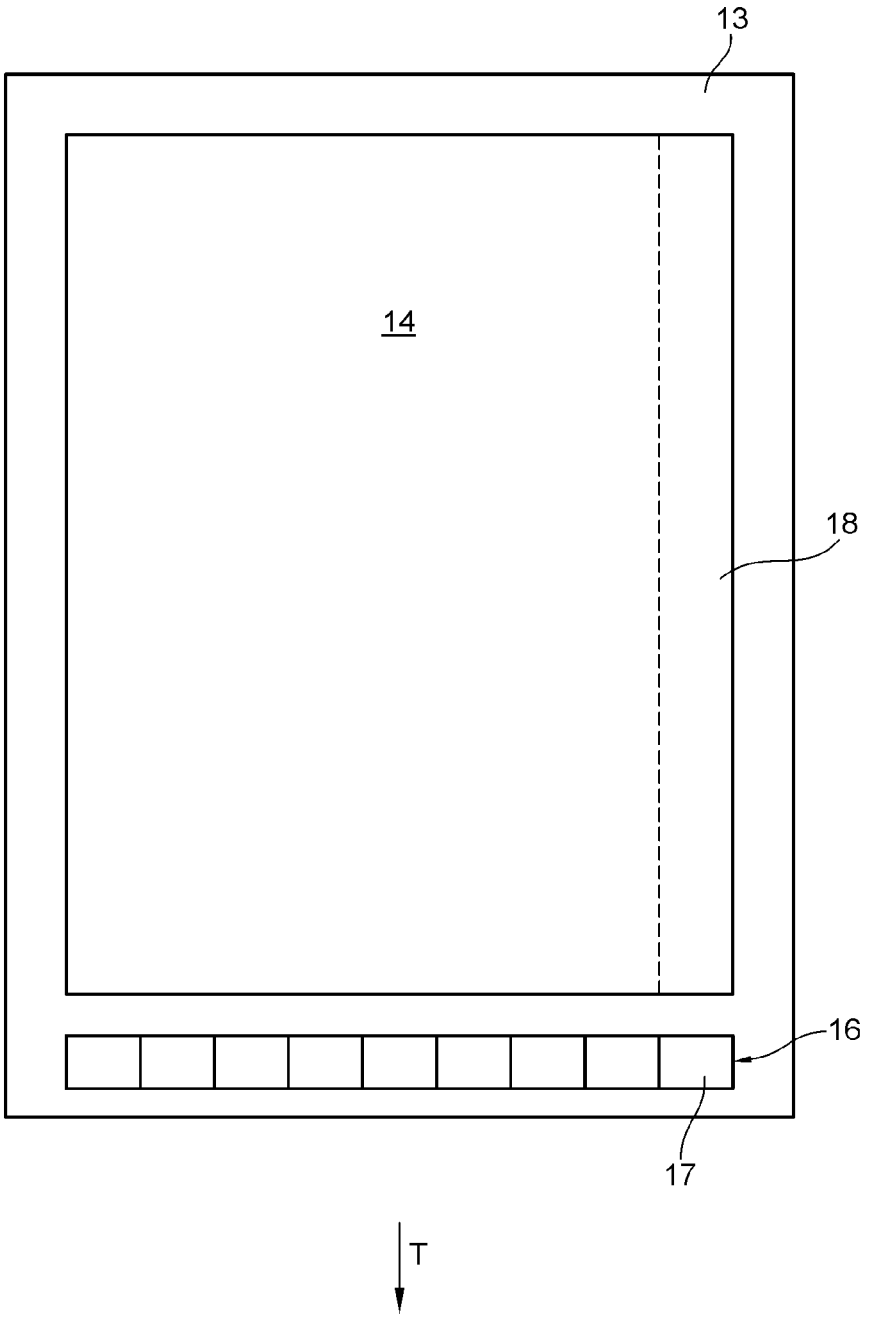
FIG. 2 a sheet with at least one print image and with one measuring strip.

FIG. 2 shows a substrate formed as a sheet 13 with at least one print image 14 and with a measuring strip 16 extending transversely as relates to the transport direction T of the substrate in question, particularly over the width of the print image 14. The measuring strip 16 has several measuring fields 17 in a row, wherein individual measuring fields 17 are coated with a respective coating material with the described application device 04, e.g. over the entire surface or in halftone, e.g. in the printing machine according to FIG. 1 in an industrial process. In the preferred embodiment, the sensing device 12 described by means of FIG. 1 is directed onto at least one measuring field 17 in the measuring strip 16 of the sheet 13, wherein the control unit 06 connected to the sensing device 12 determines the respective value of the opacity of the layer of the coating material applied in the at least one measuring field 17 in the measuring strip 16 of the sheet 13. It may be provided that the control unit 06 determines the respective value of the opacity of the respectively applied layer of the coating material from several or all measuring fields 17 in the measuring strip 16 of the sheet 13 and, depending on the determined value for the opacity of the respectively applied layer of the coating material, sets the layer thickness to be applied to at least one subsequent sheet 13 by the application device 04 individually, i.e. as needed, for several or each of the zones 18 extending in the transport direction T of the sheet 13 in question and corresponding to at least one measuring field 17. A further design variant provides that the respective value of the opacity of the respectively applied layer of the coating material is to be detected, instead of or in addition to the detection in at least one of the measuring fields 17 of the measuring strip 16, at at least one preferably selectable position in the at least one print image 14 printed onto the sheet 13.

Furthermore, it may be provided to apply the coating material at various points on the sheet 13 in question normally simultaneously in the same printing process by means of the application device 04. The points on the sheet 13 in question, which are different from one another, are, for example, at least two measuring fields 17 different from one another of the same measuring strip 16 or at least two different elements in the same print image 14. It is provided in this case that the coating material is applied at at least one first point on the sheet 13 in question in a grid respectively having several grid points, and the coating material is applied at at least one other second point on the sheet 13 in question over the entire surface. Specifically, this means, for example, that the coating material is applied particularly in at least one of the measuring fields 17 of the measuring strip 16 in question in a grid respectively having several grid points, and the coating material is applied in at least one other measuring field 17 of this measuring strip 16 over the entire surface in the same printing process by means of the application device 04. A first point formed, e.g., as a measuring field 17 on the sheet 13 in question, at which point the coating material is respectively applied in halftone, is also designated as a grid zone, while a second point formed, e.g., as a measuring field 17 on the sheet 13 in question, at which point the coating material is respectively applied over the entire surface, is also designated as a solid zone. The control unit 06 determines a respective value for the optical density of the layer of the coating material applied to the sheet 13 at the points in question from data, e.g. image data, recorded by the sensing device 12 at the respective first and second point on the sheet 13 in question.

The control unit 06 also preferably places the value DR for the optical density, determined from a grid zone, in relation to the respective value DV for the optical density, determined from a solid zone, e.g., by the formation of a ratio DR/DV. Because the optical density is proportional to the quantity of the coating material applied per unit of surface area to the sheet 13 at the points in question on the sheet 13, e.g. in the respective measuring fields 17 of the measuring strip 16, the value DR for the optical density determined in a grid zone in a printing process is less than the value DV for the optical density determined in a solid zone, at least at the start. As the layer thickness of the coating material applied in a grid zone increases, there is an increase in the optical density determined in the grid zone in question, e.g. due to a spreading of the grid points therein and/or optical effects, and the ratio formed from value DR for the optical density determined from a respective grid zone and value DV for the optical density determined from the respective solid zone changes significantly. The control unit 06 then stipulates, particularly when it determines a significant change in the ratio formed from the optical densities, i.e. as a function of this determination, the particularly layer thickness of the coating material currently being applied to the sheet 13 in question by the application device 04, at which layer thickness the value DR for the optical density determined in a grid zone corresponds to the value DV for the optical density determined in a solid zone, as the particular layer thickness of the coating material having an opacity of 100%. The significant change in the ratio formed from the optical densities may be because of the fact that, for example, the value of a ratio formed from these optical densities approximates initially the value 1 in a series of several successive data collections, i.e. determinations of these optical densities, but then stays at least practically unchanged at the value 1 for a preferably previously stipulated number of successive data collections. Thus, the control unit 06 monitors a course or a behavior of this relationship for a significant change, i.e. a change exceeding the permissible tolerance limits, in a series of several successive collections of the optical densities in question. The stipulation relating to the layer thickness of the coating material with an opacity of 100% takes place, for example, in that the control unit 06 stores the currently provided operating data and/or control data of the application device 04 in a storage device 19 in association with the opacity of 100% for the layer thickness of the coating material. Following the determination made, the control unit 06 sets the layer thickness of the coating material, which is to be applied to at least one further substrate, i.e. particularly at least one further sheet 13, by the application device 04, such that the layer of the coating material to be applied to the at least one further substrate with the application device 04 has the opacity of 100% and thus retains it in the subsequent printing process, particularly during ongoing operation of the printing machine or the paper-processing machine.

Well preferred embodiments of a method for setting a layer thickness of a covering coating material to be applied to a substrate by an application device, in accordance with the present invention, have been set forth fully and completely herein above, it will be apparent to one of skill in the art that various changes could be made thereto, without departing from the true spirit and scope of the present invention, which is to be limited only by the appended claims.

The invention claimed is:

1. A method for setting a layer thickness of a covering coating material to be applied to a substrate by an application device including:

applying the covering coating material to the substrate one of in a printing machine and in a paper-processing machine; the covering coating material being applied at least to first and second points on the substrate using the application device in a machine process;

applying the covering coating material at at least one of the first points on the substrate, the covering coating material being applied to the at least one first point in a grid having a plurality of grid points;

applying the covering coating material at at least one of the second points on the substrate, the coating material being applied to the at least one of the second points over a full area of the at least one of the second points, wherein each first point on the substrate forms a grid zone and each second point on the substrate forms a solid zone;

using a control unit and a connected sensing device for determining a value for an optical density of the layer of the covering coating material applied at the first and second points on the substrate using data captured by the sensing device at the first and second points on the substrate and provided to the control unit;

using at least one covering printing ink as the covering coating material, and wherein the covering printing ink is formed as one of a primary color and as an opaque white and as a metallic color;

using the sensing device for continually collecting the measured values of the covering coating material applied to subsequent ones of the substrate during an ongoing operation of the one of the printing machine and the paper-processing machine, wherein the application of the covering coating material onto subsequent ones of the substrate using the application device during the ongoing operation of the one of the printing machine and the paper-processing machine is monitored continually with the sensing device during the ongoing production, and wherein the control unit stipulates and controls a layer thickness of the covering coating material applied to the subsequent ones of the substrate by the application device in the ongoing operation, at which stipulated and controlled layer thickness a value (DR) for an optical density determined in a grid zone corresponds to a value (DV) for an optical density determined in a solid zone, as a layer thickness of the covering coating material having an opacity of 100%.

2. The method according to claim 1, wherein the control unit sets the layer thickness of the coating material, which is to be applied to at least one further substrate by the application device in the ongoing operation, such that the layer of the coating material to be applied to the at least one subsequent substrate, with the application device, has the opacity of 100% in the further ongoing operation of the one of the printing machine and the paper-processing machine.

3. The method according to claim 1, wherein, for defining the layer thickness of the covering coating material having the opacity of 100%, the control unit stores one of currently provided operating data and control data of the application device in a storage device in association with the opacity of 100% for the layer thickness of the coating material.

4. The method according to claim 1, characterized in that wherein the control unit sets the respective value (DR) for the optical density determined from a grid zone in relation to the respective value (DV) for the optical density determined from a solid zone, and defines the layer thickness of the covering coating material currently being applied to the substrate by the application device in the ongoing operation, as the particular layer thickness of the covering coating material having the opacity of 100% when the control unit determines a significant change in one of a course and a behavior of this relationship in a series of several sequential collections of the optical densities.

5. The method according to claim 1, further including providing a measuring strip having several measuring fields on the substrate and wherein at least a first measuring field, which is formed as the grid zone on said measuring strip, and wherein at least a second measuring field, which is formed as the solid zone on said measuring strip, are used as the at least first and second points on the substrate.

6. The method according to claim 1, wherein a printing substrate is used as the substrate, wherein the printing substrate one of consists of one of paper and paperboard and sheet metal and textiles, and glass and ceramics, and consists of one of a film comprising one of metal and plastic and wherein the printing substrate is formed as one of a hollow object and as a sheet and as a material web.

7. The method according to claim 1, wherein one of a liquid and a paste and a powder coating material is used as the covering coating material.

8. The method according to claim 1, wherein a colorant is used as the covering coating material, wherein the colorant is formed as one of a color-providing inorganic and as an organic substance, wherein the colorant is one of natural and synthetic origin and wherein the colorant has one of pigments and at least one dye.

9. The method according to claim 1, wherein the sensing device functions without contact and with an optoelectronic measuring method and densitometrically and spectrophotometrically.

10. The method according to claim 1, further including providing the application device has having a metering device which is one of controlled and regulated by the control unit, wherein the metering device influences a quantity of the covering coating material to be applied to the substrate by one of setting a width of at least one discharge opening of a reservoir supplying the covering coating material and by setting a cycle of a lifter transferring the covering coating material and by setting a rotational speed of a roller one of applying and transferring the covering coating material to be applied to the substrate.

* * * * *